United States Patent [19]

Culling

[11] Patent Number: 5,011,659

[45] Date of Patent: Apr. 30, 1991

[54] CASTABLE CORROSION RESISTANT ALLOY

[75] Inventor: John H. Culling, St. Louis, Mo.

[73] Assignee: Carondelet Foundry Company, St. Louis, Mo.

[21] Appl. No.: 497,584

[22] Filed: Mar. 22, 1990

[51] Int. Cl.[5] ..... C22C 30/00

[52] U.S. Cl. ..... 420/582; 420/584.1; 420/586.1

[58] Field of Search ..... 420/582, 584.1, 586.1

[56] References Cited

U.S. PATENT DOCUMENTS

| | | | |
|---|---|---|---|
| 2,777,766 | 1/1957 | Binder | 420/582 |
| 3,565,611 | 2/1971 | Economy | 420/445 |
| 3,811,875 | 5/1974 | Goda et al. | 420/41 |
| 4,035,182 | 7/1977 | Kowaka et al. | 420/582 |
| 4,078,920 | 3/1978 | Liljas et al. | 420/40 |
| 4,201,575 | 5/1980 | Henthorne et al. | 148/442 |
| 4,400,349 | 8/1983 | Kudo et al. | 420/443 |
| 4,410,489 | 10/1983 | Asphahani et al. | 420/453 |
| 4,487,744 | 12/1984 | DeBold et al. | 420/584 |

FOREIGN PATENT DOCUMENTS

| | | | |
|---|---|---|---|
| 2426414 | 12/1974 | Fed. Rep. of Germany | 420/582 |

*Primary Examiner*—Melvyn Andrews
*Assistant Examiner*—Robert R. Koehler
*Attorney, Agent, or Firm*—Senniger, Powers, Leavitt & Roedel

[57] ABSTRACT

Austenitic stainless steel casting alloys which have excellent resistance to seawater, other chloride solutions, and a broad spectrum of other chemical substances, but which do not require solution heat treatments, after welding or other exposure to heat, such as in the slow cooling of large, rangy castings from the molten state. The alloys also posses very high tensile elongation values, excellent weldability and resistance to thermal and mechanical shock. The alloys are comprised, by weight, of from about 28% to about 34% Ni, from about 22% to about 26% Cr, from about 3.3% to about 4.4% Mo, from about 2% to about 3% W, from about 1% to about 3% Cu, from about 0.2% to about 0.9% Si, from about 0.3% to about 1.3% Mn, up to about 0.05%, but preferably not more than about 0.03% C, and the balance essentially iron, plus the usual impurities encountered in conventional production practice. The alloys may optionally contain up to about 0.3% Nb, up to about 0.20% Ti, and up to about 0.25% each of Al and V.

10 Claims, No Drawings

CASTABLE CORROSION RESISTANT ALLOY

BACKGROUND OF THE INVENTION

For the last three decades there has been an increasing interest in and demand for metallic alloys that are resistant to chloride solutions as well as to a broad spectrum of other corrosive solutions. For example, power plants and chemical process equipment are now often cooled by seawater or brackish water. In addition, metallic alloys resistant to seawater are useful in many ship, submarine, dock, drilling and platform construction applications. It is, of course, desirable that these alloys bear the lowest cost consistent with meeting the requirements of each application.

A now widely accepted index of corrosion resistance of alloys to chloride solutions has been developed. This index has a numerical value derived by adding together chromium content plus 3.3 times molybdenum content plus 16 times nitrogen content, all contents being weight percentages of these elements in a given alloy. This relationship has proven to be a very useful indicator of the relative corrosion resistance of alloys composed primarily of iron, nickel, chromium, molybdenum and nitrogen in acid chloride solutions. The value of this index for various alloys has ranged from about a low of 26 for type 316L stainless steel to a high of over 50 for the most advanced nickel-base alloys, whose costs run four to seven times that of 316L.

One of the earliest broad spectrum alloys of outstanding resistance to seawater and other chloride solutions was a nickel-base alloy marketed under the tradename, Hastelloy C, which nominally contained, by weight, 16% Cr, 16% Mo, 4% W, 5% Fe, a few impurities and the remainder Ni. This alloy was furnished in both cast and wrought forms and had to be given a solution heat treatment at about 2100° F. prior to use in service. This alloy has undergone several modifications over the years due to the problems with corrosion in weld areas because of the precipitation of Mo-rich and W-rich intermetallic phases. Also, while the alloys of this type have good resistance to reducing acids they have limited resistance to oxidizing acid environments. One version, known as Hastelloy C-22, designed to provide improved resistance to oxidizing acid environments, contains nominally 22% Cr, 13% Mo, 2.5% W and 3% Fe with the balance essentially Ni.

The nickel-base alloy, Inconel 625, contains about 22% Cr, 9% Mo, 4% Cb plus Ta and 61% Ni and has somewhat better resistance to strong oxidizing substances than the Hastelloy C family of alloys; however, it is still a premium, high-cost material. Also it is now known that, columbium (niobium) is somewhat detrimental to resistance to chlorides, so that Inconel 625 is not as resistant in the presence of strong oxidizers as might be expected from the Cr and Mo contents of the alloy.

Binder, U.S. Pat. No. 2,777,766, discloses alloys of 18% to 23% Cr, 35% to 50% Ni, 2% to 12% Mo, 0.1% to 5% Cb plus Ta, up to 0.25% C, up to 2.5% Cu, up to 5% W, and the balance iron and impurities. While none of the exemplary alloys employed any tungsten, the commercial alloy derived from the patent and sold under the tradename, Hastelloy G, nominally contained about 6.5% Mo and up to about 1% W. This alloy has rather poor resistance to chlorides relative to its alloying elements content, probably due in part to its high columbium content.

Hastelloy G was modified to increase its molybdenum content to about 7.1%, and reduce columbium and tantalum content to about 0.5% while keeping the tungsten at about 1% or slightly less. This modified alloy, Hastelloy G3, still suffered local corrosion in U.S. Navy tests in filtered seawater.

Henthorne, et al, U.S. Pat. No. 4,201,575, discloses an alloy marketed under the tradename, 20Mo6, which nominally contained about 35% Ni, 25% Cr, 6% Mo, 2% Cu and the balance essentially Fe. This alloy was intended for service in acid chlorides, and at about 30% Fe content, had departed considerably from the Ni-base category. However, it was prone to intergranular attack after welding unless it was subsequently solution heat treated at high temperature. Furthermore, it did not meet expectations for broad spectrum corrosion resistance, possibly due to its marked tendency to form microstructural transformation phases.

DeBold, et al, U.S. Pat. No. 4,487,744, discloses an alloy known as 20Mo4 which nominally contains 37% Ni, 23% Cr, 4% Mo, 1% Cu, 0.2% Cb and the balance essentially Fe. This alloy was intended to avoid the problems of alloy 20Mo6 and still have resistance to chlorides and a broad spectrum of other corrosive solutions. It has fairly good resistance to sulfuric and nitric acids and is not susceptible to intergranular attack after welding, but it is not completely immune to local corrosion in seawater.

Liljas, et al, U.S. Pat. No. 4,078,920, discloses highly modified 316L stainless steel and contains nominally 18% Ni, 20% Cr, 6.2% Mo, 0.8% Cu, 0.2% N and the balance essentially Fe. The alloying approach of this alloy provides excellent resistance to local corrosion in seawater and to many reducing substances but only moderate resistance to oxidizing solutions.

High-manganese austenitic stainless steels of reduced nickel contents have sometimes contained nitrogen and molybdenum, but none of these steels offer very high resistance to acid chlorides. A high-silicon version of these steels was said to have increased chloride resistance, but neither that version nor any other high-Si alloy so far developed has been able to provide significantly increased resistance to acid chlorides.

Economy, U.S. Pat. No. 3,565,611, discloses alloys for resistance to stress corrosion cracking in caustic alkalies which are composed of 18% to 35% Cr, up to about 7% Fe, and optional amounts of up to about 3% each of V,W,Ta, up to 1% Cb, up to 4% Al, up to 1% Ti, up to 6% each of Cu, Co and Mn, and the balance essentially Ni. The claims require that the sum of V, W, and Mo is less than 6%. While molybdenum and tungsten are both optional in the alloys of Economy, it is well recognized in the field that there is no known austenitic Ni-base or Fe-Ni-Cr base alloy that contains no molybdenum and still has resistance to chlorides.

Goda, et al, U.S. Pat. No. 3,811,875, discloses austenitic stainless steel alloys containing 10% to 26% Cr, 4% to 46% Ni, 0.5% to 10% Cu, 0.25% to 2% Al and optionally up to about 3.5% Mo. Goda further claims that up to about 7% W may optionally replace all or part of the molybdenum. However, as stated above, such alloys, devoid of molybdenum, do not have significant resistance to chlorides.

Kudo, et al, U.S. Pat. No. 4,400,349, claims alloys resistant to chlorides containing 20% to 60% Ni, 15% to 35% Cr, 3% to 20% Mn, up to 24% W, 0 to 12% Mo, up to 2% Cu, optional amounts of Co, Y, Ti, Mg Ca and rare earths, with the balance essentially iron and impurities. Kudo further specifies that the weight percent of chromium plus 10 times molybednum plus 5 times tungsten taken together must exceed 50%. The exemplary alloys of Kudo encompass more restricted portions of the disclosed compositional ranges, but still provide only tensile elongation values of 8.7% to a maximum of 26%, with the vast majority of the alloys falling below about 20%.

Asphahani, et al, U.S. Pat. No. 4,410,489, discloses alloys said to be particularly resistant to phosphoric acid and composed of 26% to 35% Cr, 3% to 6% Mo, 1% to 4% W, 0.3% to 2% Cb plus Ta, 1% to 3% Cu, up to 1.5% Mn, up to 15% Si, 10 to 18% Fe, and the balance essentially Ni. An alloy offered under the tradename, G-30, nominally contains 43% Ni, 30% Cr, 5.5% Mo, 2.5% W, 2% Cu, 1% Si, 0.8% Cb and 0.03% C. This alloy is claimed to provide excellent resistance to a variety of severe environments, especially hot phosphoric acid.

However, alloy G-30 contains such large amounts of chromium along with the other strong ferritizing elements, molybdenum and tungsten, that it tends to form sigma and other detrimental phases when slowly cooled from the molten state, as in the production of large castings. Also, despite its low carbon content, alloy G-30 tends to suffer attack by many corrosive substances in the weld and heat affected zone, and accordingly large castings or welded castings are solution heat treated at high temperatures before being put into service.

In addition, duplex stainless steels have developed rapidly and have received wide acceptance in many types of chloride service. The newer duplex stainless steels have adequately answered the welding problems for wrought product assemblies, such as pipe lines, but both cast and wrought duplex stainless steels of superior resistance to chlorides must be solution heat treated at some stage of production.

Therefore, there have been no prior art alloys of any type that have essentially complete resistance to seawater and generally excellent resistance to more severe chloride solutions as well as a wide range of other solutions, that do not require solution heat treatments at high temperature. Such heat treatments applied to large castings are costly, difficult and severe, in that they lock in high stresses in the final shapes and often cause cracking or distortion.

Thus there has remained a need for alloys of moderate cost, excellent resistance to chlorides and to other substances, high tensile elongation and weldability, but which do not require solution heat treatments prior to service, even after welding.

SUMMARY OF THE INVENTION

It is therefore an object of this invention to provide austenitic stainless steel casting alloys which have excellent resistance to seawater, other chloride solutions, and a broad spectrum of other chemical substances, but which do not require solution heat treatments after welding or other exposure to heat, such as in the slow cooling of large, rangy castings from the molten state. An additional object is to provide such alloys with very high tensile elongation values, excellent weldability and resistance to thermal and mechanical shock.

Yet another object is to provide alloys which may be readily melted and cast by ordinary practices and equipment without the requirements of special atmospheres or techniques. An even further object is to provide alloys of sufficiently low nickel content and high iron content that they may be readily formulated from ferroalloys and similarly lower cost melting materials as contrasted to nickel-base alloys of very low or no tolerance to iron. Another object is to provide alloys which do not require intentional nitrogen addition.

These and other objects are fulfilled, acording to this invention, by austenitic corrosion resistant alloys which are comprised, by weight, from about 28% to about 34% Ni, from about 22% to about 26% Cr, from about 3.3% to about 4.4% Mo, from about 2% to about 3% W, from about 1% to about 3% Cu, from about 0.2% to about 0.9% Si, from about 0.3% to about 1.3% Mn, up to about 0.05%, but preferably not more than about 0.03% C, and the balance essentially iron, plus the usual impurities encountered in conventional production practice. The alloys may optionally contain up to about 0.3% Cb, up to about 0.2% Ti, and up to about 0.25% each of Al and V.

Other objects and features will be in part apparent and in part pointed out hereinafter.

DETAILED DESCRIPTION OF THE INVENTION

The present invention is directed to austenitic corrosion resistant alloys suitable for casting from simple, small shapes up through large, complex, rangy shapes but capable of being wrought or forged.

The major components of the alloys of the invention are:

| | |
|---|---|
| NICKEL | 28–34% by weight |
| CHROMIUM | 22–26% |
| MOLYBDENUM | 3.3–4.4% |
| TUNGSTEN | 2–3% |
| COPPER | 1–3% |
| SILICON | 0.2–0.9% |
| MANGANESE | 0.3–1.3% |
| IRON | essentially balance |

The alloys of the invention will also contain carbon, up to a maximum of about 0.05 by weight, but preferably only up to about 0.03% maximum by weight.

The alloys of the invention may further contain, by weight, up to about 0.25% each of Al and V, up to about 0.2% Ti, up to about 0.3% Cb and the usual impurities encountered in normal production of such alloys, including small amounts of cobalt, as encountered in certain nickel ore deposits and considered a part of the nickel content. The alloys of the invention may further contain small amounts of nitrogen as encountered in ordinary melting and pouring but do not have nitrogen intentionally added. The following examples further illustrate the invention.

EXAMPLE 1

One hundred pound heats of several different alloys were prepared in accordance with the invention. Each of the heats were air-melted in a 100-pound high frequency induction furnace. The composition of these alloys is set forth in Table I, with the balance in each instance being essentially iron.

TABLE I

| ALLOY NUMBER | ALLOY COMPOSITION- % BY WEIGHT ALLOYING ELEMENTS | | | | | | | |
|---|---|---|---|---|---|---|---|---|
| | Ni | Cr | Mo | W | Cu | Mn | Si | C |
| 1497 | 32.97 | 22.54 | 3.50 | 2.01 | 2.96 | 0.56 | 0.60 | 0.006 |
| 1509 | 32.58 | 24.02 | 3.51 | 2.52 | 2.01 | 0.63 | 0.46 | 0.013 |
| 1516 | 28.11 | 24.50 | 4.32 | 2.03 | 2.12 | 0.72 | 0.46 | 0.009 |
| 1517 | 29.81 | 25.82 | 3.31 | 2.68 | 1.22 | 0.59 | 0.46 | 0.008 |
| 1518 | 33.11 | 25.23 | 3.33 | 2.04 | 1.07 | 0.48 | 0.48 | 0.014 |
| 1519 | 33.31 | 24.04 | 3.53 | 2.53 | 2.06 | 0.63 | 0.53 | 0.01 |

Standard physical test blocks and corrosion test bars were prepared from each heat.

EXAMPLE 2

In addition corrosion test bars were cast for a number of comparative alloys not of the invention. The composition of these comparative alloys is set forth in Table II, with the balance in each instance being essentially iron.

TABLE II

| ALLOY NUMBER | COMPOSITION OF COMPARATIVE ALLOYS- % BY WEIGHT ALLOYING ELEMENTS | | | | | | | | | |
|---|---|---|---|---|---|---|---|---|---|---|
| | Ni | Cr | Mo | Cu | Si | Mn | C | N | Cb | W |
| 1439 | 36.88 | 31.16 | 4.95 | 3.55 | 5.03 | 0.29 | 0.06 | 0.41 | — | — |
| 1446 | 9.65 | 27.23 | 4.73 | 1.22 | 0.62 | 0.41 | 0.02 | 0.21 | — | — |
| 1455 | 9.87 | 27.88 | 5.85 | 1.02 | 0.51 | 0.79 | 0.01 | 0.20 | — | — |
| 1494(1) | 47.44 | 28.26 | 4.54 | 1.51 | 0.65 | 0.74 | 0.02 | — | 0.82 | 2.02 |
| 1495(2) | 36.90 | 23.93 | 4.30 | 2.99 | 0.75 | 0.62 | 0.01 | — | 0.32 | 1.99 |
| 1496 | 28.15 | 24.13 | 5.03 | 2.86 | 0.62 | 0.57 | 0.01 | — | 0.25 | 0.63 |
| 1498(3) | 23.96 | 31.94 | 3.49 | 1.85 | 0.23 | 0.76 | 0.03 | — | — | 2.47 |
| 1514(3) | 20.39 | 24.09 | 2.68 | 1.99 | 0.91 | 0.47 | 0.02 | 0.18 | — | 1.04 |
| 1515 | 8.81 | 27.98 | 1.08 | 2.40 | 0.89 | 0.68 | 0.01 | 0.18 | — | 0.49 |
| 1520(3,4) | 46.54 | 28.54 | 1.36 | — | 0.34 | 5.88 | 0.02 | — | — | 2.78 |
| 1521(3) | 33.17 | 34.62 | — | — | 0.14 | 4.62 | 0.01 | — | — | 3.31 |
| 1522(3) | 45.88 | 25.22 | 3.16 | — | 0.37 | 4.53 | 0.01 | 0.23 | — | — |

(1)Alloy No. 1494 is the same as the preferred alloy of Asphahani, et al, U.S. Pat. No. 4,410,489.
(2)Alloy No. 1495 falls within the composition of Binder, U.S. Pat. No. 2,777,766.
(3)Test alloys Nos. 1498 and 1514 fall within the composition ranges of Kudo, U.S. Pat. No. 4,400,349, except that they have lower manganese contents. Test alloys Nos. 1520, 1521 and 1522 were prepared entirely in accordance with Kudo and corresponding almost exactly with the three best alloys as represented by alloy Nos. 10, 11 and 24 of Kudo.
(4)Alloy No. 1520 falls within the composition of Economy, U.S. Pat. No. 3,565,611, except that it contains 14.58% Fe, while alloys of that patent contain up to 8% Fe.

EXAMPLE 3

Using the as-cast, non-heat treated standard physical test blocks, each heat of Example 1 standard tensile test bars were machined and the mechanical properties of each were measured. The results of the measurements are set forth in Table II.

TABLE III

| ALLOY NUMBER | MECHANICAL PROPERTIES OF ALLOYS OF THE INVENTION | | | | |
|---|---|---|---|---|---|
| | TENSILE STRENGTH P.S.I. | YIELD STRENGTH P.S.I. | TENSILE ELONGATION % | REDUCTION IN AREA % | BRINELL HARDNESS NUMBER |
| 1497 | 68,800 | 30,100 | 42.5 | 65.2 | 123 |
| 1509 | 69,700 | 29,500 | 51.5 | 67.1 | 126 |
| 1516 | 65,800 | 30,300 | 61.0 | 58.2 | 112 |
| 1517 | 74,200 | 31,400 | 45.0 | 47.7 | 131 |
| 1518 | 66,600 | 33,200 | 43.5 | 50.2 | 121 |
| 1519 | 66,400 | 33,300 | 42.5 | 50.5 | 125 |

Comparative alloy No. 1494 developed an as-cast tensile elongation of 28% as compared to the range of 43% to 5% (61% ?) elongation for alloys of the invention.

EXAMPLE 4

The as-cast non-heat-treated corrosion test bars of the alloys of the invention as well as those from the comparative alloys of Example 2 were machined into 1½ inch diameter by ¼ inch thick discs, each having ⅛ inch diameter hole in the center. These discs were carefully machined to size, polished to a 600-grit finish, pickled 5 hours in 35% nitric acid at 80° C. to remove any dust, cutting oil or foreign matter, rinsed in water and dried on a hot plate at 120° C. Each disc was weighed to the nearest 10,000th of a gram.

Sample discs were tested at room temperature, which was 24° C. (75° F.), in accordance with the procedure of Method A of ASTM STANDARD G48-76 (Reapproved 1980) for testing pitting resistance of alloys by the use of ferric chloride solution. In accordance with the test specification each sample was held for 72 hours in a glass cradle immersed in 600-ml beaker and covered with a watch crystal. The ferric chloride solution was prepared by dissolving 100 gm of reagent grade ferric chloride, $FeCl_3.6H_2O$, in each 900 ml of distilled water (about 6% $FeCl_3$ by weight).

Each disc was then scrubbed with a nylon bristle brush under running water to remove corrosion products, soaked in 1000 ml of hot tap water for two hours to dissolve any chlorides remaining in any pits, rerinsed, and then dried on a hot plate for an hour at 120° C. Each specimen was then again weighed to the nearest 10,000th of a gram and the weight loss recorded.

Sample discs from each of the alloys of the invention, as well as from the best comparative alloys, were also autogenously welded by tungsten intert gas welding. The welding beads were formed on each face of each disc by welding a circle at the periphery of each disc face connected by a cross, i.e., two perpendicular diameter line welds. Autogenous welding was selected, since no welding filler wires of the same compositions as those of the discs are available. These welded discs were also submitted to the ferric chloride test without any heat treatment after welding.

No visible pitting was observed under a magnification of ten power on any of the samples of the alloys of the invention; the weight losses were minute. Contrariwise, all of the comparative alloy samples showed various amounts of attack as a result of the welding.

For convenience of comparison, the weight loss was converted to a figure of average depth of penetration in mils per year, MPY, in accordance with the relationship:

$$MPY = 393.7 \frac{Wo - Wf}{ATD}$$

where

Wo=original weight of sample

Wf=final weight of sample

A=area of sample in square centimeters

T=duration of the test in years

D=density of the alloy in grams per cubic centimeter

The results from these tests are set forth in Table IV.

TABLE IV

| AVERAGE MPY LOSS IN 6% FERRIC CHLORIDE SOLUTION AT 24° C. (75° F.) | | |
|---|---|---|
| SAMPLE NUMBER | AS-CAST CONDITION | WELDED CONDITION |
| ALLOYS OF THE INVENTION | | |
| 1497 | 0.6 | 2.8 |
| 1509 | 0.6 | 3.3 |
| 1516 | 0.1 | 0.5 |
| 1517 | 0.2 | 1.4 |
| 1518 | 0.8 | 4.2 |
| 1519 | 0.5 | 2.3 |
| ALLOYS NOT OF THE INVENTION | | |
| 1439 | 412.2 | NT |
| 1446 | 26.4 | 512.8 |
| 1455 | 291.6 | NT |
| 1494 | 0.2 | 120.7 |
| 1495 | 10.5 | 241.6 |
| 1496 | 1.6 | 153.5 |
| 1498 | 432.0 | NT |
| 1514 | 466.4 | NT |
| 1515 | 419.6 | NT |
| 1520 | 482.3 | NT |
| 1521 | 455.7 | NT |
| 1522 | 44.8 | 386.5 |

NT = NOT TESTED

A metallic alloy in an application in which it suffers less than a tenth of a mil per year attack or less would be considered almost impervious or unaffected. Alloys of less than about 5 MPY would certainly be considered "very good" materials or as giving excellent service life in most chemical handling or power generating equipment. These alloys would be suitable for all parts, such as valve seats, pump shafts and rings, small springs, etc., where very long service life is required.

It is evident, therefore, from the results of the tests described in Example 4 that the instant alloys possess outstanding corrosion resistance properties.

EXAMPLE 5

Test discs of the alloys of the invention set forth in Table I and of comparative alloys Nos. 1498 and 1521 were immersed to a depth of about 1¾ inches of natural seawater taken from the Atlantic Ocean at Myrtle Beach, SC. The seawater was held at room temperature in plastic containers with tightly-fitted lids with a water change every two weeks. The discs were examined weekly for evidence of pitting, after being rinsed and dried. Observation was made with a 10-power magnifying glass. Comparative alloys 1498 and 1521 displayed visible attack in the form of red rust spots by the end of the first week. The size of the rust spots increased and visible pits also formed over the reminder of the six months exposure period. None of the discs from alloys of the invention showed any visible attach at the end of six months.

EXAMPLE 6

The procedure of ASTM standard A-262 requires testing for 48 hours in boiling 65% nitric acid to determine susceptibility to intergranular corrosive attack as well as the presence of sigma phase. However, that procedure may be accompanied by the formation of hexavalent chromium ions that increase corrosivity of the nitric acid solution by a factor as much as one hundred times or more. Boiling 25% nitric acid doesn't present this problem and was utilized for the present tests, because the test alloys are of such high chromium contents and because the 25% acid strength will also reveal the presence of undesirable phases, such as sigma, as well as the tendency of an alloy toward intergranular attack.

Therefore, as-cast samples and welded samples, prepared as above for alloys of the invention were tested in accordance with the ASTM A-262 procedure, except that boiling 25% nitric acid was used in place of 65% acid. The results of these tests are set forth in Table V.

TABLE V

| ATTACK IN MPY IN BOILING 25% NITRIC ACID | | |
|---|---|---|
| ALLOY NUMBER | AS-CAST CONDITION | WELDED CONDITION |
| 1497 | 5.1 | 5.3 |
| 1509 | 5.1 | 5.4 |
| 1516 | 1.7 | 2.3 |
| 1517 | 2.3 | 2.8 |
| 1518 | 3.8 | 4.8 |
| 1519 | 2.8 | 4.2 |

Inasmuch as all of the comparative alloys showed severe attack in the ferric chloride test either in the as-cast or in the welded but not heat treated condition, no further tests were performed on those alloys, because resistance to chlorides without need for high temperature solution heat treatment is one of the main requirements for alloys of the invention.

EXAMPLE 7

One of the objects of this invention is to provide alloys that are resistant to seawater attack. Since seawater coolant in power plants and chemical industry heat exchanges may reach temperatures well above ambient values, alloys of the invention were tested in boiling seawater for 48 hours. The results of these tests are set forth in Table VI.

TABLE VI

| MPY ATTACK IN BOILING SEAWATER | |
|---|---|
| ALLOY NUMBER | |
| 1497 | 0.3 |
| 1509 | 0.0 |
| 1516 | 0.4 |
| 1517 | 0.2 |
| 1518 | 0.1 |

TABLE VI-continued

| MPY ATTACK IN BOILING SEAWATER | |
|---|---|
| ALLOY NUMBER | |
| 1519 | 0.1 |

EXAMPLE 8

Various concentrations of sulfuric acid in water present a variety of corrosive conditions. Alloys which have good resistance at 80° C. (176° F.) to a wide range of these concentrations have proven to be capable of resisting a broad spectrum of corrosive substances. Alloys of the invention were tested in several sulfuric acid-water concentrations for 8 hours at 80° C. The results of these tests are set forth in Table VII.

TABLE VII

MPY CORROSION RATE AT 80° C. IN VARIOUS SULFURIC ACID-WATER SOLUTIONS

| ALLOY | % SULFURIC ACID BY WEIGHT | | | | | | |
|---|---|---|---|---|---|---|---|
| NUMBER | 1% | 5% | 10% | 25% | 40% | 50% | 96% |
| 1497 | 0.0 | 0.2 | 0.6 | 4.0 | 2.4 | 2.8 | 9.6 |
| 1509 | 0.0 | 0.3 | 0.6 | 0.3 | 0.7 | 0.6 | 3.8 |
| 1516 | 0.0 | 0.2 | 0.2 | 0.3 | 0.8 | 3.5 | 3.1 |
| 1517 | 0.0 | 0.0 | 0.0 | 0.7 | 0.0 | 0.6 | 2.0 |
| 1518 | 0.0 | 0.0 | 0.3 | 0.2 | 0.9 | 0.8 | 1.1 |
| 1519 | 0.0 | 0.0 | 0.0 | 0.2 | 0.8 | 0.7 | 1.3 |

It is essential to alloys of the present invention that the content of aluminum and of vanadium each be held to a maximum of about 0.25%. In the case of aluminum, larger amounts reduce ductility and weldability and promote the formation of ferrite and other phases which lower corrosion resistance. Larger amounts of vanadium do not decrease weldability but tend to form ferrite at the matrix grain boundaries resulting in selective corrosive attack there.

In view of the above, it will be seen that the several objects of the invention are achieved and other advantageous results attained. As will be apparent to those skilled in the art, various changes can be made in the embodiments described above without departing from the spirit and scope of the invention and it is intended, therefore, that all matter contained in the above description shall be interpreted as illustrative and not in a limiting sense.

What is claimed is:

1. A castable corrosion resistant alloy having improved weldability and high tensile elongation consisting essentially of:

| | |
|---|---|
| Nickel | 28–34% by weight |
| Chromium | 22–26% |
| Molybdenum | 3.3–4.4% |
| Tungsten | 2–3% |
| Copper | 1–3% |
| Silicon | 0.2–0.9% |
| Manganese | 0.3–1.3% |
| Carbon | up to about 0.05% |
| Thiobium | up to about 0.3% |
| Aluminum | up to about 0.25% |
| Vanadium | up to about 0.25% |
| Titanium | up to about 0.2% |
| Iron | essentially the balance. |

2. An alloy of claim 1 wherein the carbon content is up to about 0.03% by weight.

3. An alloy of claim 2 wherein the nickel, chromium, copper, manganese, silicon and carbon contents are:

| | |
|---|---|
| Nickel | 28–33% by weight |
| Chromium | 24–26% |
| Copper | 1.2–2.2% |
| Manganese | 0.6–0.75% |
| Silicon | 0.4–0.5% |
| Carbon | up to about 0.02% |

4. An alloy of claim 2 wherein the nickel, chromium, tungsten, copper, manganese, silicon and carbon contents are:

| | |
|---|---|
| Nickel | 28–33.5% by weight |
| Chromium | 24–26% |
| Tungsten | 2–2.7% |
| Copper | 1–2.2% |
| Manganese | 0.45–0.75% |
| Silicon | 0.45–0.55% |
| Carbon | up to about 0.02% |

5. An alloy of claim 2 consisting of:

| | |
|---|---|
| Nickel | 32.97% by weight |
| Chromium | 22.54% |
| Molybdenum | 3.50% |
| Tungsten | 2.01% |
| Copper | 2.96% |
| Manganese | 0.56% |
| Silicon | 0.60% |
| Carbon | 0.006% |

6. An alloy of claim 2 consisting of:

| | |
|---|---|
| Nickel | 32.58% by weight |
| Chromium | 24.02% |
| Molybdenum | 3.51% |
| Tungsten | 2.52% |
| Copper | 2.01% |
| Manganese | 0.63% |
| Silicon | 0.46% |
| Carbon | 0.013% |

7. An alloy of claim 2 consisting of:

| | |
|---|---|
| Nickel | 28.11% by weight |
| Chromium | 24.50% |
| Molybdenum | 4.32% |
| Tungsten | 2.03% |
| Copper | 2.12% |
| Manganese | 0.72% |
| Silicon | 0.46% |
| Carbon | 0.009% |

8. An alloy of claim 2 consisting of:

| | |
|---|---|
| Nickel | 29.81% by weight |
| Chromium | 25.82% |
| Molybdenum | 3.31% |
| Tungsten | 2.68% |
| Copper | 1.22% |
| Manganese | 0.59% |
| Silicon | 0.46% |
| Carbon | 0.008% |

9. An alloy of claim 2 consisting of:

| | |
|---|---|
| Nickel | 33.11% by weight |

-continued

| | |
|---|---|
| Chromium | 25.23% |
| Molybdenum | 3.33% |
| Tungsten | 2.04% |
| Copper | 1.07% |
| Manganese | 0.48% |
| Silicon | 0.48% |
| Carbon | 0.014% |

10. An alloy of claim 2 consisting of:

| | |
|---|---|
| Nickel | 33.31% by weight |
| Chromium | 24.04% |
| Molybdenum | 3.53% |
| Tungsten | 2.53% |
| Copper | 2.06% |
| Manganese | 0.63% |
| Silicon | 0.53% |
| Carbon | 0.01% |

* * * * *